US012480429B2

(12) United States Patent
Raimondi et al.

(10) Patent No.: US 12,480,429 B2
(45) Date of Patent: Nov. 25, 2025

(54) VARIABLE VALVE LIFT ROCKER ARM ASSEMBLY

(71) Applicant: Eaton Intelligent Power Limited, Dublin (IE)

(72) Inventors: Emanuele Raimondi, Turin (IT); Massimo D'Amore, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/548,329

(22) PCT Filed: Mar. 11, 2022

(86) PCT No.: PCT/EP2022/025100

§ 371 (c)(1),
(2) Date: Aug. 29, 2023

(87) PCT Pub. No.: WO2022/189042

PCT Pub. Date: Sep. 15, 2022

(65) Prior Publication Data

US 2024/0141808 A1 May 2, 2024

Related U.S. Application Data

(60) Provisional application No. 63/159,521, filed on Mar. 11, 2021.

(51) Int. Cl.
*F01L 1/18* (2006.01)
*F01L 13/00* (2006.01)
(Continued)

(52) U.S. Cl.
CPC ..... *F01L 1/181* (2013.01); *F01L 13/0005* (2013.01); *F01L 2001/186* (2013.01); *F01L 1/26* (2013.01);
(Continued)

(58) Field of Classification Search
CPC ..... F01L 1/181; F01L 2001/186; F01L 2001/467; F01L 13/0005; F01L 2305/00; F01L 2305/02
See application file for complete search history.

(56) References Cited

U.S. PATENT DOCUMENTS 6,412,460 B1 * 7/2002 Sato ..... F01L 1/053 123/90.27
2010/0064994 A1 * 3/2010 Colliou ..... F02B 75/021 123/90.39
(Continued)

FOREIGN PATENT DOCUMENTS

DE 102009041368 A1 * 3/2011 ..... F01L 1/185
DE 102011085708 A1 * 5/2013 ..... F01L 1/181
(Continued)

OTHER PUBLICATIONS

JP 2001329817 A, English Language Machine Translation (Year: 2001).*
(Continued)

*Primary Examiner* — Wesley G Harris
(74) *Attorney, Agent, or Firm* — Baker Botts L.L.P.

(57) ABSTRACT

A variable valve lift rocker arm assembly can include a latching axle assembly comprising a roller latch assembly and a first latch receiver assembly; an outer body configured to rotate around a rocker shaft, the outer body comprising at least a valve end, and a cam end comprising an outer axle bore for seating the first latch receiver assembly of the latching axle assembly; an inner body configured to rotate around the rocker shaft, the inner body comprising an inner axle bore configured for seating the roller latch assembly of the latching axle assembly; a main roller operatively coupled to the outer body; and a secondary roller operatively coupled to the inner body; wherein the roller latch assembly and the
(Continued)

first latch receiver assembly are configured to selectively operatively couple the outer body to the inner body.

19 Claims, 8 Drawing Sheets

(51) Int. Cl.
*F01L 1/26* (2006.01)
*F01L 1/46* (2006.01)

(52) U.S. Cl.
CPC ..... *F01L 2001/467* (2013.01); *F01L 2305/02* (2020.05)

(56) References Cited

U.S. PATENT DOCUMENTS

| | | | | |
|---|---|---|---|---|
| 2011/0303168 | A1 | 12/2011 | Ting | |
| 2014/0251266 | A1* | 9/2014 | Emmons | F02D 13/04 123/321 |

FOREIGN PATENT DOCUMENTS

| | | | | |
|---|---|---|---|---|
| DE | 102011085709 | A1 * | 5/2013 | F01L 1/181 |
| EP | 0826867 | A1 * | 3/1998 | F01L 1/18 |
| EP | 1143120 | A2 | 10/2001 | |
| EP | 3170997 | A1 * | 5/2017 | F01L 1/047 |
| GB | 2333322 | A * | 7/1999 | F01L 1/2411 |
| JP | H 10-073009 | A | 3/1998 | |
| JP | 2001329817 | A * | 11/2001 | F01L 13/00 |
| JP | 2009047111 | A | 3/2009 | |
| JP | 6305768 | B2 * | 4/2018 | F01L 13/00 |
| WO | WO-2010100753 | A1 * | 9/2010 | F01L 1/185 |
| WO | WO-2010136875 | A1 * | 12/2010 | F01L 1/185 |

OTHER PUBLICATIONS

International Search Report and Written Opinion for International Application No. PCT/EP 2022/025100, 17 pages, Jun. 30, 2022.

* cited by examiner

VARIABLE VALVE LIFT ROCKER ARM ASSEMBLY

PRIORITY

This application claims the benefit under 35 U.S.C. § 371 of International Patent Application No. PCT/EP2022/025100, filed Mar. 11, 2022, which claims the benefit of priority of U.S. Provisional Patent Application No. 63/159,521, filed Mar. 11, 2021, which are incorporated herein by reference in its entirety.

FIELD

This application relates to rocker arm assemblies and, more particularly, to variable valve lift rocker arm assemblies with a switchable roller for use in, for example, a valve train of an internal combustion engine, allowing the use of deactivation and other variable valve actuation techniques.

BACKGROUND

An internal combustion engine can include a valve train assembly. A valve train assembly includes rocker arms for controlling the opening and closing of intake and exhaust valves. A rocker arm is a reciprocating lever that translates radial motion of a rotating camshaft lobe into linear motion that controls the opening and closing of a valve. The rocker arm is mounted on a rocker shaft with one end in direct or indirect contact with a rotating camshaft lobe and the other end being structurally interfaced with a valve.

Variable valve actuation mechanisms, such as cylinder deactivation and variable valve lift, have been introduced to improve engine performance, fuel economy, and/or emissions of an internal combustion engine. To support a variable valve actuation mechanism, a switchable rocker arm can be used.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY

A variable valve lift rocker arm assembly can include a latching axle assembly comprising a roller latch assembly and a first latch receiver assembly; an outer body configured to rotate around a rocker shaft, the outer body comprising at least a valve end, and a cam end comprising an outer axle bore for seating the first latch receiver assembly of the latching axle assembly; an inner body configured to rotate around the rocker shaft, the inner body comprising an inner axle bore configured for seating the roller latch assembly of the latching axle assembly; a main roller operatively coupled to the outer body; and a secondary roller operatively coupled to the inner body; wherein the roller latch assembly and the first latch receiver assembly are configured to selectively operatively couple the outer body to the inner body.

A variable valve lift rocker arm assembly can include a roller latch assembly seated in a shaft bushing within a secondary roller.

A variable valve lift rocker arm assembly can include a roller latch assembly comprising a first latch pin, wherein the first latch pin is configured to move between a latched position, in which the first latch pin engages with a first latch receiver assembly to lock the relative rotation between an inner body and an outer body, and an unlatched position, in which the first latch pin disengages from the first latch receiver assembly to enable relative rotation between the inner body and the outer body.

A variable valve lift rocker arm assembly can include a roller latch assembly further comprising a second latch pin: wherein a latching axle assembly further comprises a second latch receiver assembly in an outer body, wherein the second latch pin is configured to engage with the second latch receiver assembly in the latched position, and wherein the second latch pin is configured to disengage from the second latch receiver assembly in the unlatched position.

A variable valve lift rocker arm assembly can include a first latch receiver configured to selectively press on a roller latch assembly to selectively unlatch an inner body from an outer body.

A variable valve lift rocker arm assembly can include a latching axle assembly comprising a first roller latch assembly, a second roller latch assembly, first latch receiver assembly, and a second latch receiver assembly; an outer body comprising: at least one valve end; an outer bore shaft; and an axle bore for receiving a first portion of the latching axle assembly; a first inner body comprising: a first inner bore shaft; and a first inner axle bore for receiving a second portion of the latching axle assembly; a second inner body comprising: a second inner bore shaft; and a second inner axle bore for receiving a third portion of the latching axle assembly; a first roller operatively coupled to the first roller latch assembly and the first inner body; and a second roller operatively coupled to the second roller latch assembly and the second inner body; wherein the first latch receiver assembly and the second latch receiver assembly are operatively coupled to the outer body, wherein the first roller latch assembly is configured to selectively latch or unlatch with the first latch receiver assembly, wherein the second roller latch assembly is configured to selectively latch or unlatch with the second latch receiver assembly, wherein the outer body is selectively operatively coupled to the first inner body and to the second inner body by the latching axle assembly, and wherein the first inner body and the second inner body are configured to selectively rotate, independently of the other, relative to the outer body.

A variable valve lift rocker arm assembly can include a first roller latch assembly comprising a first latch pin; wherein a second roller latch assembly comprises a second latch pin; wherein the first roller latch assembly is configured to latch or unlatch with a first latch receiver assembly via the first latch pin; wherein the second roller latch assembly is configured to latch or unlatch with a second latch receiver assembly via the second latch pin.

A variable valve lift rocker arm assembly can include a latching axle assembly further comprising a third latch receiver assembly and a fourth latch receiver assembly; wherein the third latch receiver assembly and the fourth latch receiver assembly are operatively coupled within an outer body; wherein a second latch roller assembly is configured to selectively latch or unlatch with the third latch receiver assembly; wherein a first latch roller assembly is configured to selectively latch or unlatch with the fourth latch receiver assembly.

A variable valve lift rocker arm assembly can include a first roller latch assembly comprising a first latch pin and a fourth latch pin; wherein a second roller latch assembly comprises a second latch pin and a third latch pin, wherein a first latch receiver assembly is configured to engage or disengage the first latch pin, wherein a third latch receiver assembly is configured to engage or disengage the third latch pin, wherein a second latch receiver assembly is configured to engage or disengage the second latch pin, and wherein a fourth latch receiver assembly is configured to engage or disengage the fourth latch pin.

A variable valve lift rocker arm assembly can include a first roller latch assembly and a second roller latch assembly that are independently latched or unlatched.

A variable valve lift rocker arm assembly can include a first lost motion spring operatively coupled to an outer body and to a first inner body; and a second lost motion spring operatively coupled to the outer body and to a second inner body.

A variable valve lift rocker arm assembly can include a first roller lying on a same axis as a second roller when both the first roller and the second roller are in cam base circle position.

A variable valve lift rocker arm assembly can include a latching axle assembly; an outer body comprising at least one valve end, an outer bore shaft, and an outer axle bore for receiving the latching axle assembly; an inner body comprising an inner bore shaft and an inner axle bore for receiving the latching axle assembly; and a roller operatively coupled to the latching axle assembly and the inner body, wherein the outer body is operatively coupled to the inner body by the latching axle assembly, wherein the outer body is configured to selectively rotate relative to the inner body via the rocker shaft, wherein the latching axle assembly comprises a roller latch assembly operatively coupled to the inner body and to the roller, and wherein a first latch receiver assembly is operatively coupled to the outer body.

A variable valve lift rocker arm assembly can include a roller latch assembly comprising a first latch pin, and wherein the first latch pin is configured to engage with a first latch receiver assembly to move between a latched position, in which the first latch pin engages with the first latch receiver assembly to lock the relative rotation between an inner body and an outer body, and an unlatch position, in which the first latch pin disengages from the first latch receiver assembly to allow relative rotation between the inner body and the outer body.

A variable valve lift rocker arm assembly can include a roller latch assembly comprising a second latch pin, an outer body comprising a second latch receiver assembly, a first latch pin and the second latch pin are configured to engage with a first latch receiver assembly and the second latch receiver assembly in a latched position, in which the first latch pin engages with the first latch receiver assembly and the second latch pin engages with the second latch receiver assembly to lock the relative rotation between an inner body and an outer body, and the first latch pin and the second latch pin are configured to engage with the first latch receiver assembly and the second latch receiver assembly in an unlatched position, in which the first latch pin disengages from the first latch receiver assembly and the second latch pin disengages from the second latch receiver assembly to allow relative rotation between the inner body and the outer body.

Additional objects and advantages will be set forth in part in the description which follows, and in part will be obvious from the description, or can be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1:
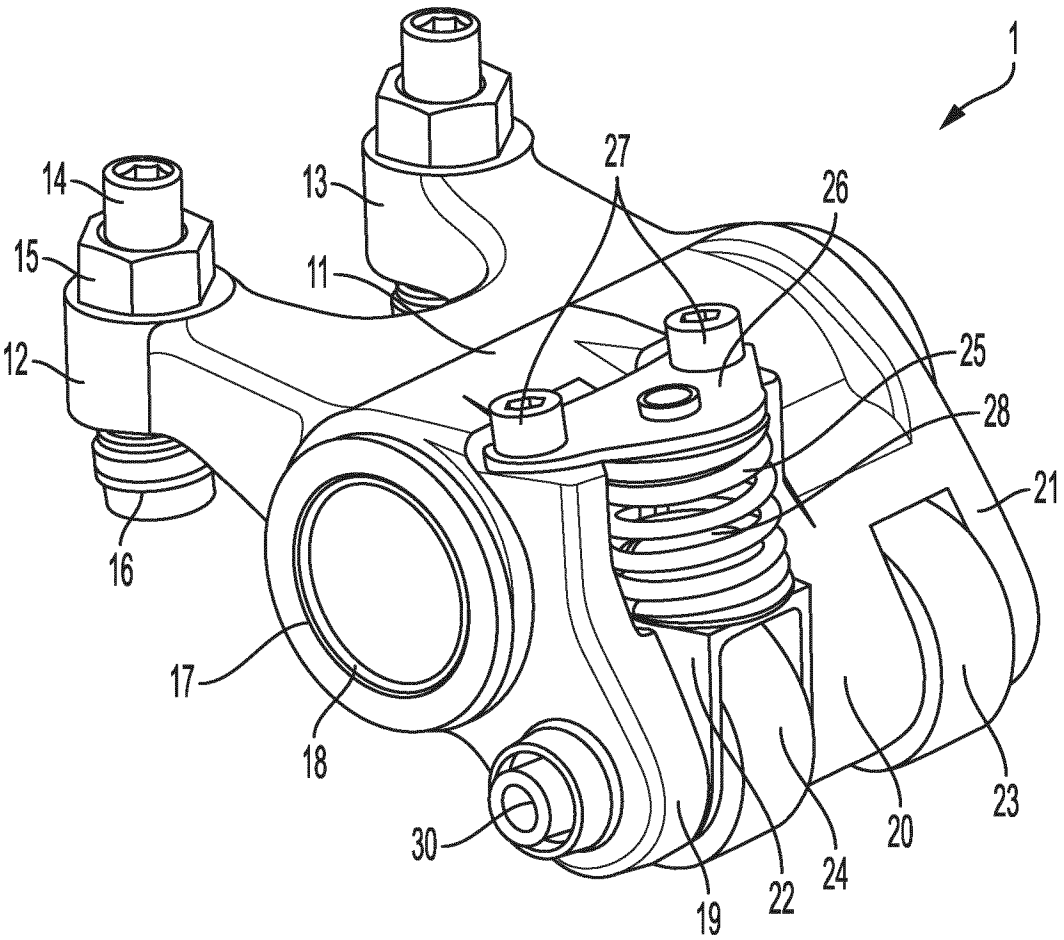
FIG. 1 is a perspective view of a variable valve lift rocker arm assembly with roller deactivation.

FIG. 1 illustrates a perspective view of a variable valve lift rocker arm assembly 1 with roller deactivation for an internal combustion engine according to an exemplary embodiment of the present disclosure. Rocker arm assembly 1 can be configured to support various variable valve actuation mechanisms in internal combustion engines. Further, while the disclosed embodiment can be particularly beneficial for enabling variable valve lift on type III (center pivot) valve trains, the present disclosure can be applied to, or used in connection with, many other types of valve train systems and configurations comprising one or more cam-actuated roller. Similarly, while the disclosed embodiment may be particularly beneficial to heavy duty vehicles and machines, the present disclosure can be applied to, or used in connection with, many other types of vehicles and applications.

As seen in FIG. 1, outer body 11 can comprise at least one valve end. Outer body is illustrated with two valve ends: first valve end 12 and second valve end 13 on the valve side of outer body 11. First valve end 12 and second valve end 13 include a bore hole (not pictured) through which, in this embodiment, a threaded rod 14 is coupled. Threaded rod 14 is secured by nut 15. Elephant foot 16 is coupled to threaded rod 14 for interfacing directly or indirectly with a valve stem or other structure associated with a valve. The bore holes of first valve end 12 and second valve end 13 can accommodate other components in lieu of, or in addition to, threaded rod 14, nut 15, and elephant foot 16. For example, a spigot, a lash adjuster, an actuatable capsule, or a piston, among other options can be a component in the bores.

Outer body 11 comprises an outer shaft bore 17 which can be configured to receive a rocker shaft 18. Rocker shaft 18 can be substituted with a pivoting axle or other suitable structure. As one option, a bushing for surrounding the rocker shaft 18 can be inserted in the outer shaft bore 17 and inner shaft bore 31. The bushing can be fitted on the rocker shaft 18. Rocker shaft 18 can comprise fluid galleries for supplying lubrication fluid or control fluid to one or both of the first and second valve ends 12, 13 and the first and second actuation ports 74, 75. The outer bodies 11, 901 can be drilled or otherwise formed so that control fluid can connect to the first and second actuation ports 74, 75 from the outer shaft bores. Fluid pathways can likewise be formed from outer shaft bore to valve ends, among other options.

Outer body 11 further comprises at least three cam ends, first cam end 19, second cam end 20, and third cam end 21 which accommodate inner body 22, main roller 23, and secondary roller 24.

Inner body 22, which will be discussed further in subsequent sections, is an interface between secondary roller 24 and outer body 11, and comprises an inner shaft bore 31 configured to receive rocker shaft 18, and inner axle bore 32 configured to receive latching axle assembly 30 to be discussed below. Inner body 11 can comprise a "C"-shape to receive secondary roller 24. A portion of the inner body 11, such as inner lost motion spring retainer 28, can join inner body arms 221, 222. Inner body arms 221, 222 can be perforated so that inner shaft bore 31 and inner axle bore 29 are formed on both sides of the "C"-shape of inner body 22. For example, rocker shaft 18 or a bushing can be seated in corresponding perforations forming inner shaft bore 31. Shaft bushing 34 can span inner axle bores 32. Main roller 23 and secondary roller 24 can be configured to interface with camshaft lobes of a valve train assembly.

Lost motion spring 25, positioned between outer body 11 and inner body 2, can comprise a first end connected to inner body 22 and a second end connected to outer body 11. In this embodiment, lost motion spring 25 is secured to outer body 11 by outer lost motion spring retainer 26 which is, in turn, secured to outer body 11 via outer lost motion spring retainer posts 27. Other fasteners can be used to secure lost motion spring retainer 25 to outer body 11, such as screws, nuts, rivets, among other options. Lost motion spring 25 can be secured to inner body 22 by inner lost motion spring retainer 28. Other fasteners can be used, such as piston assemblies. So too, other sources of lost motion spring tension can be used.

Latching axle assembly 30 can be installed in an axle bore 29 that extends through first cam end 19, second cam end 20, and third cam end 21 of outer body 11, as well as inner body 22, main roller 23, and secondary roller 24. Axle bore 29, when passing through outer body 11, can be known as an outer axle bore 291. Additional portions of the axle bore 29 can comprise second and third outer axle bores 292, 293 formed in the second cam end 20 and third cam end 21, respectively. Axle bore 29 is configured to receive latching axle assembly 30. Latching axle assembly 30, like axle bore 29, extends through first cam end 19, second cam end 20, and third cam end 21 of outer body 11, as well as inner body 22, main roller 23, and secondary roller 24. Latching axle assembly 30, which comprises at least one latching mechanism, will be discussed further below.

Figure 2:
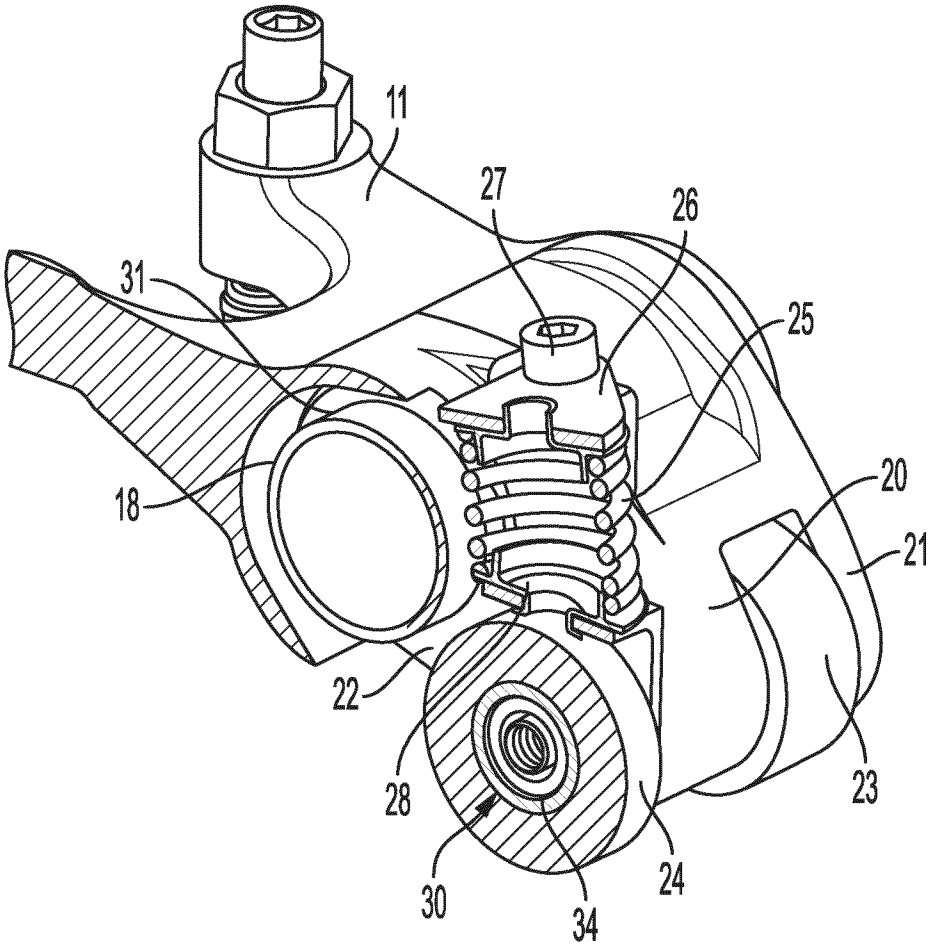
FIG. 2 is a cut-away perspective view of a variable valve lift rocker arm assembly with roller deactivation.

FIG. 2. illustrates a cut-away perspective view of a variable valve lift rocker arm assembly with roller deactivation.

As shown in FIG. 2, outer body 11 includes an outer shaft bore 17 that can receive an optional shaft bushing or rocker shaft 18. Rocker shaft 18 also passes through inner body 22 and enables outer body 11 and inner body 22 to be rotatably coupled. For purposes of manufacture, the rocker shaft 18 does not need to be included in the rocker arm assembly 1 until it is installed on a valvetrain. The optional bushing can be installed in the rocker arm assembly 1 to stabilize the inner body 22 relative to the outer body 11 prior to installation in a valvetrain.

Figure 3:
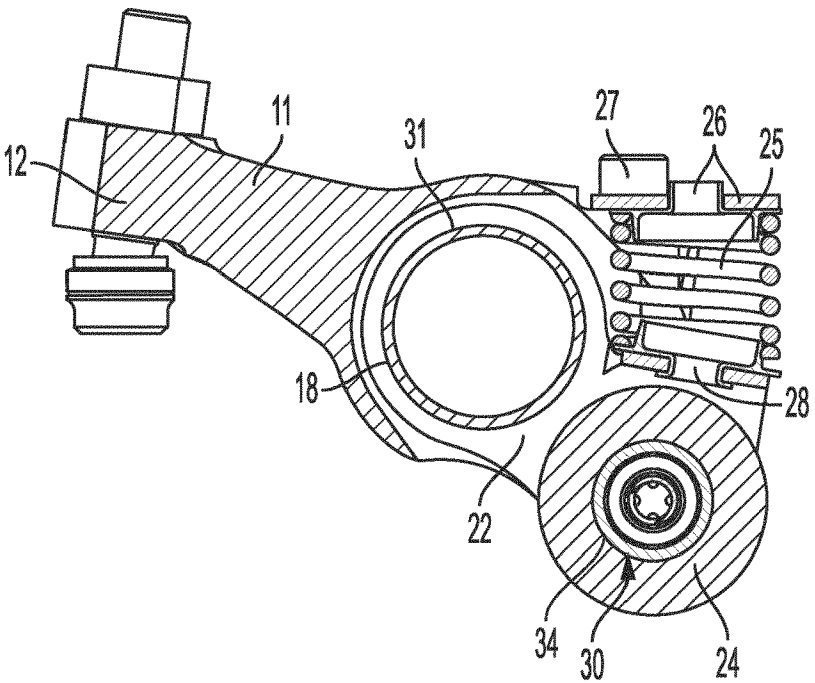
FIG. 3 is a cut-away profile view of a variable valve lift rocker arm assembly with roller deactivation in a cam base circle position, the cut-away taken from an approximately similar direction as that of FIG. 2.

FIG. 3 illustrates a cut-away profile of a variable valve lift rocker arm assembly with roller deactivation in a cam base circle position, the cut-away taken from an approximately similar direction as that of FIG. 2.

Generally, a cam mounted on a camshaft is spun and the cam, as it turns, either directly or indirectly, exerts pressure on a roller. The profile of the cam can include lobes corresponding to valve lift events. Cam base circle positions correspond to portions of the cam profile where there are no lobes and the pressure exerted by the cam on a roller, directly or indirectly, is at a minimum. Cam lift mode positions correspond to portions of the cam profile where there are cam lobes and the pressure exerted by the cam on a roller, directly or indirectly, is greater relative to the pressure exerted by the cam in cam base circle position so as to cause the valve end to move one or more affiliated valve.

In FIG. 3, inner shaft bore 31 is shown in the cross-section of inner body 22. Rocker shaft 18 passes through inner shaft bore 31. Rocker shaft 18 traverses outer body 11 and inner body 22 and couples outer body 11 with inner body 22, and allows inner body 22 to pivot with respect to outer body 11, and vice versa.

Latching axle assembly 30, via axle bore 29, passes through main roller 23 and secondary roller 24, outer body 11, and inner body 22.

Figure 4:
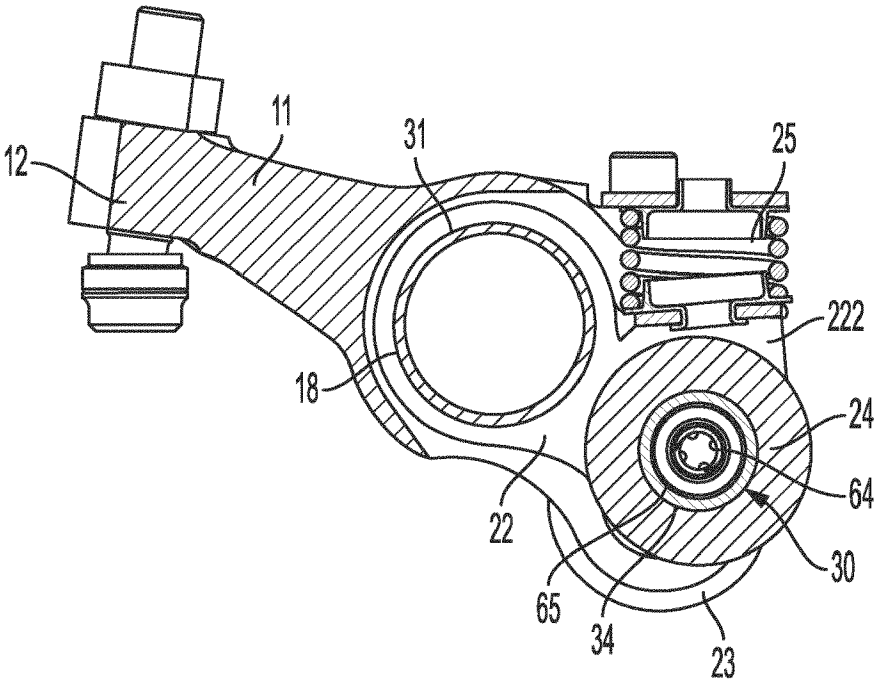
FIG. 4 is cut-away profile view of a variable valve lift rocker arm assembly with roller deactivation in a cam lift position, wherein a roller is offset and a lost motion spring is actuating, the cut-away taken from an approximately similar direction as that of FIG. 2.

FIGS. 3, 5, 6, 8, & 9 show rocker arm assembly 1 in a cam base circle position, with no valve lift force applied by a camshaft lobe on secondary roller 24. In FIGS. 4 & 7, camshaft lobe applies valve lift force, and the valve lift force is transmitted via inner body 22 and outer body 11 to valve end 12 and valve end 13. Lost motion spring 25 acting on inner body 22 will position secondary roller 24 to be on the same axis as main roller 23 in FIG. 3, such that the two rollers 23, 24 are aligned on the same axis. While, secondary roller 24 is aligned with main roller 23 on the same axis in a cam base circle position, other configurations can include secondary roller 24 being offset from main roller 23 in a cam base circle position.

FIG. 4. illustrates a cut-away profile view of a variable valve lift rocker arm assembly with roller deactivation in a cam lift mode position wherein a roller is offset, the cut-away taken from an approximately similar direction as that of FIG. 2.

As FIG. 4. shows, the variable valve lift rocker arm assembly 1 with a secondary roller 24 is in an unlatched mode. In FIG. 4, a camshaft lobe— in a cam lift mode position—has driven secondary roller 24 and inner body 22 upwards. Secondary roller 24 and inner body 22 thus pivot with respect to outer body 11 along the axis (facing into and out from the page) defined by inner shaft bore 31 and rocker shaft 18.

This motion also compresses lost motion spring 25 between outer body 11 and inner body 22, thus some of the force from the camshaft lobe and a portion of the resulting motion is absorbed by the lost motion spring 25. If the lost motion spring 25 absorbs all of the force, the secondary roller 24 is considered completely deactivated. But, is also possible for a portion of the force from the camshaft lobe motion to be conveyed to valve ends 12 and/or 13 for a partially deactivated variable valve lift function. Note that main roller 23 remains fixed with respect to outer body 11, even while secondary roller 24 is movable with respect to outer body 11. When the cam returns to a cam base circle position, the force from the camshaft lobe subsides and lost motion spring 25 will drive inner body 22 and secondary roller 24 back to the approximate configuration shown in FIG. 3.

Figure 5:
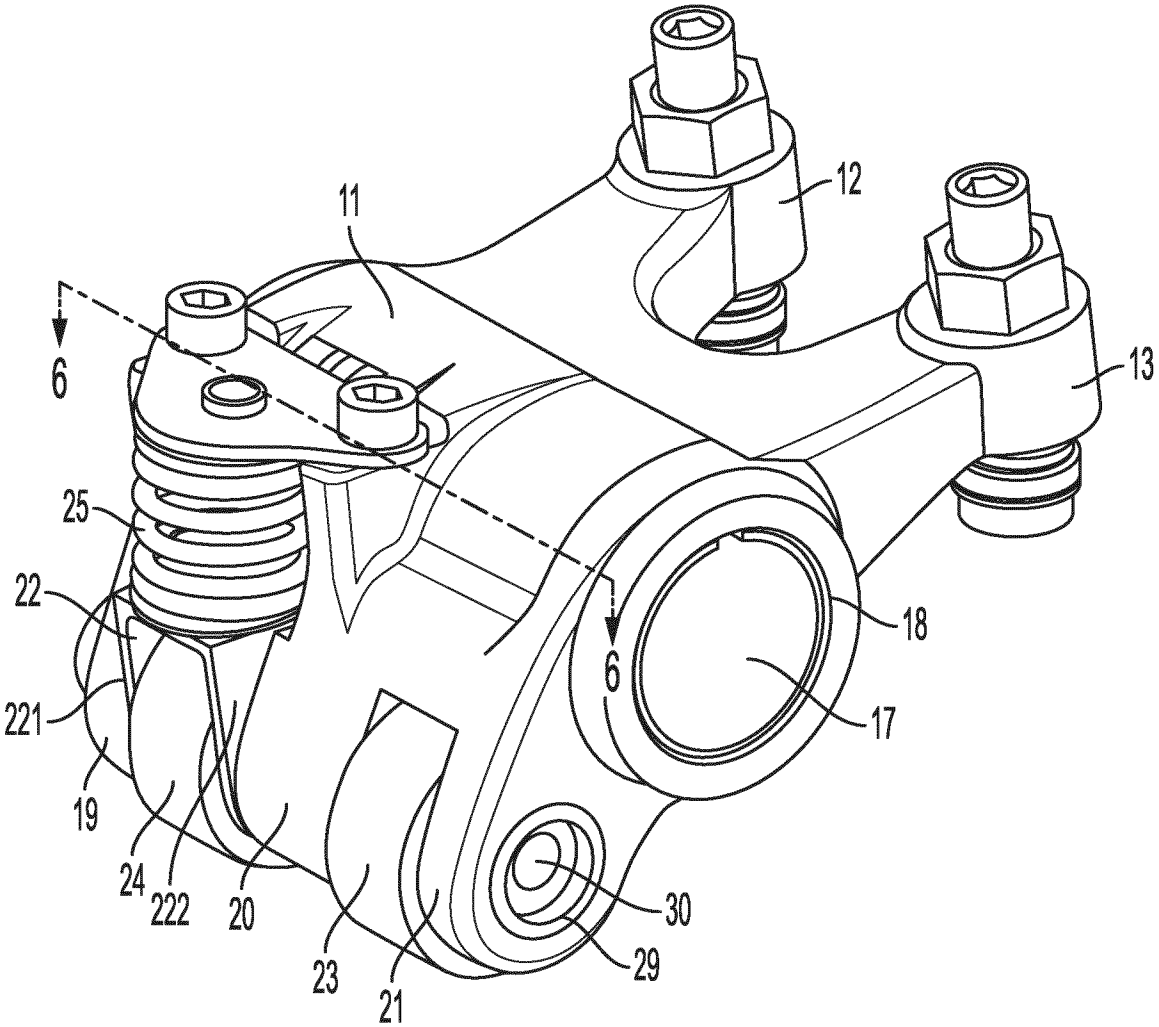
FIG. 5 is another perspective view of a variable valve lift rocker arm assembly with roller deactivation in a cam base circle position.

FIG. 5 is a perspective view of a variable valve lift rocker arm assembly with roller deactivation from a different angle than previously illustrated.

As shown in FIG. 5, rocker shaft 18 can be configured to pass completely through outer body 11 and inner body 22. Latching axle assembly 30 can pass completely through outer body 11 through first cam end 19, second cam end 20, and third cam end 21, as well as inner body 22, main roller 23, and secondary roller 24.

Figure 6:
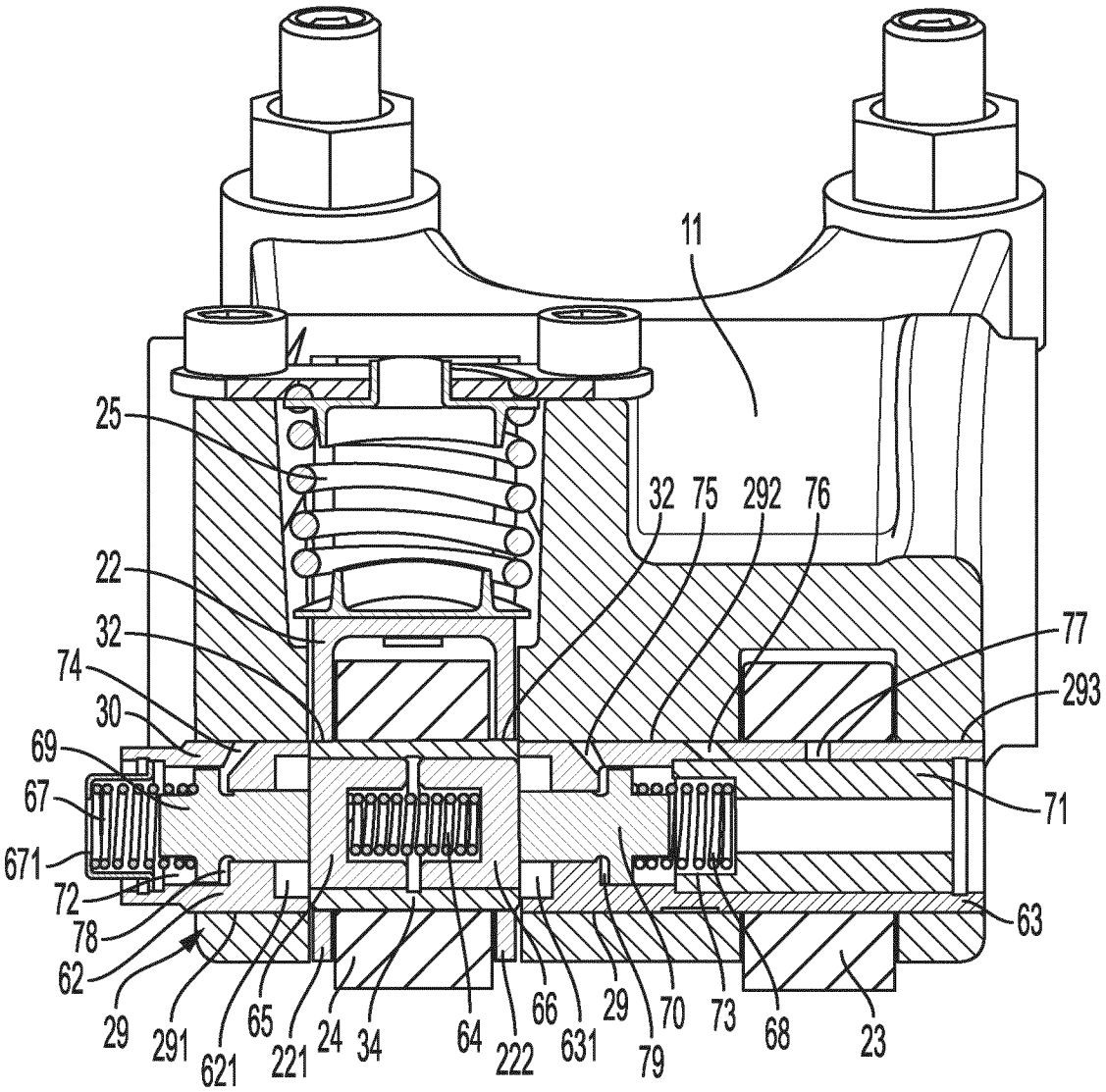
FIG. 6 is a cut-away profile view of a variable valve lift rocker arm assembly with roller deactivation in unlatched mode, the cut-away taken approximately from line 6 of FIG. 5.
Figure 7:
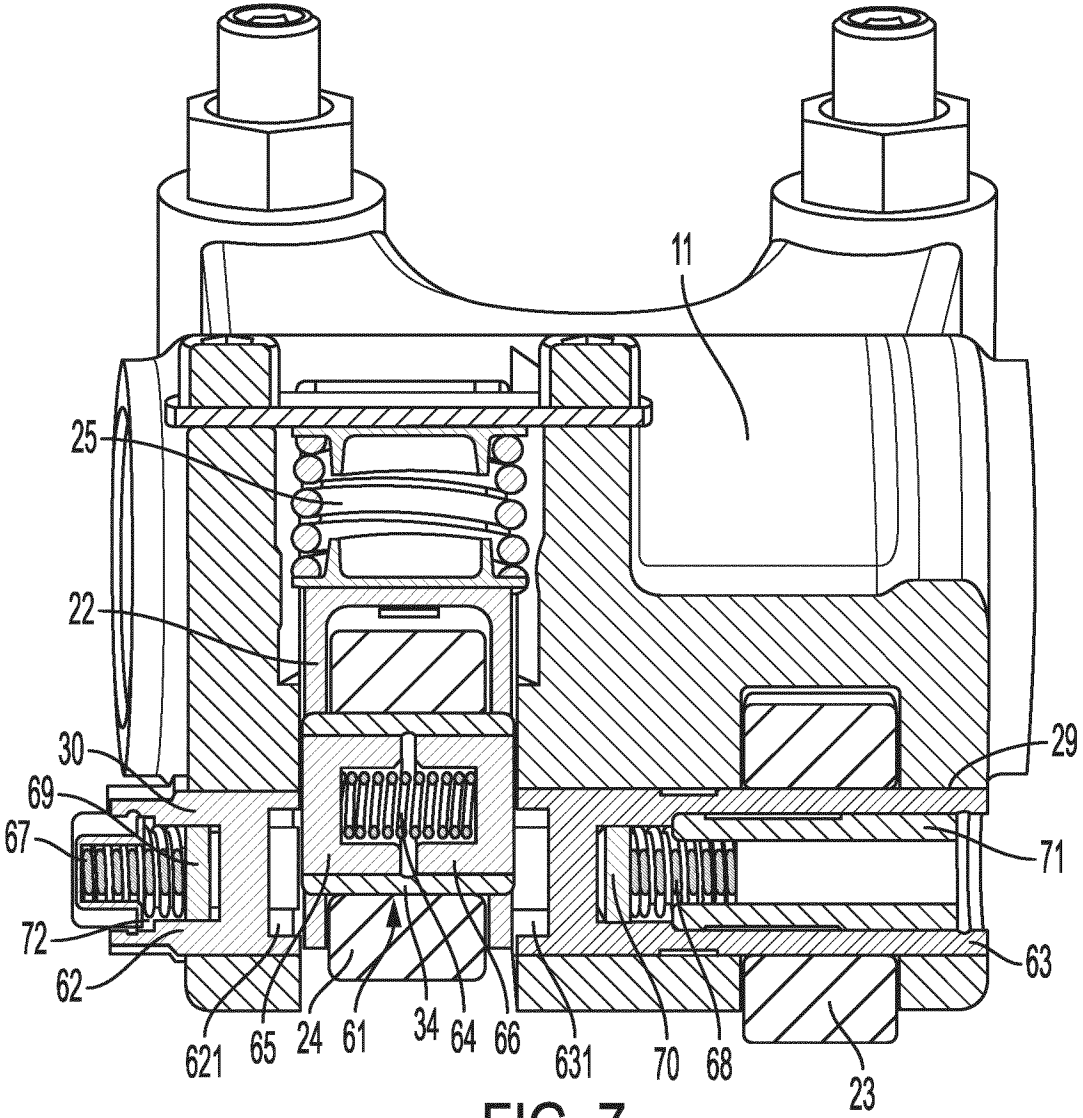
FIG. 7 is a cut-away profile view of a variable valve lift rocker arm assembly with roller deactivation in unlatched mode with an offset roller in a cam lift position, the cut-away taken approximately from line 6-6 of FIG. 5.
Figure 8:
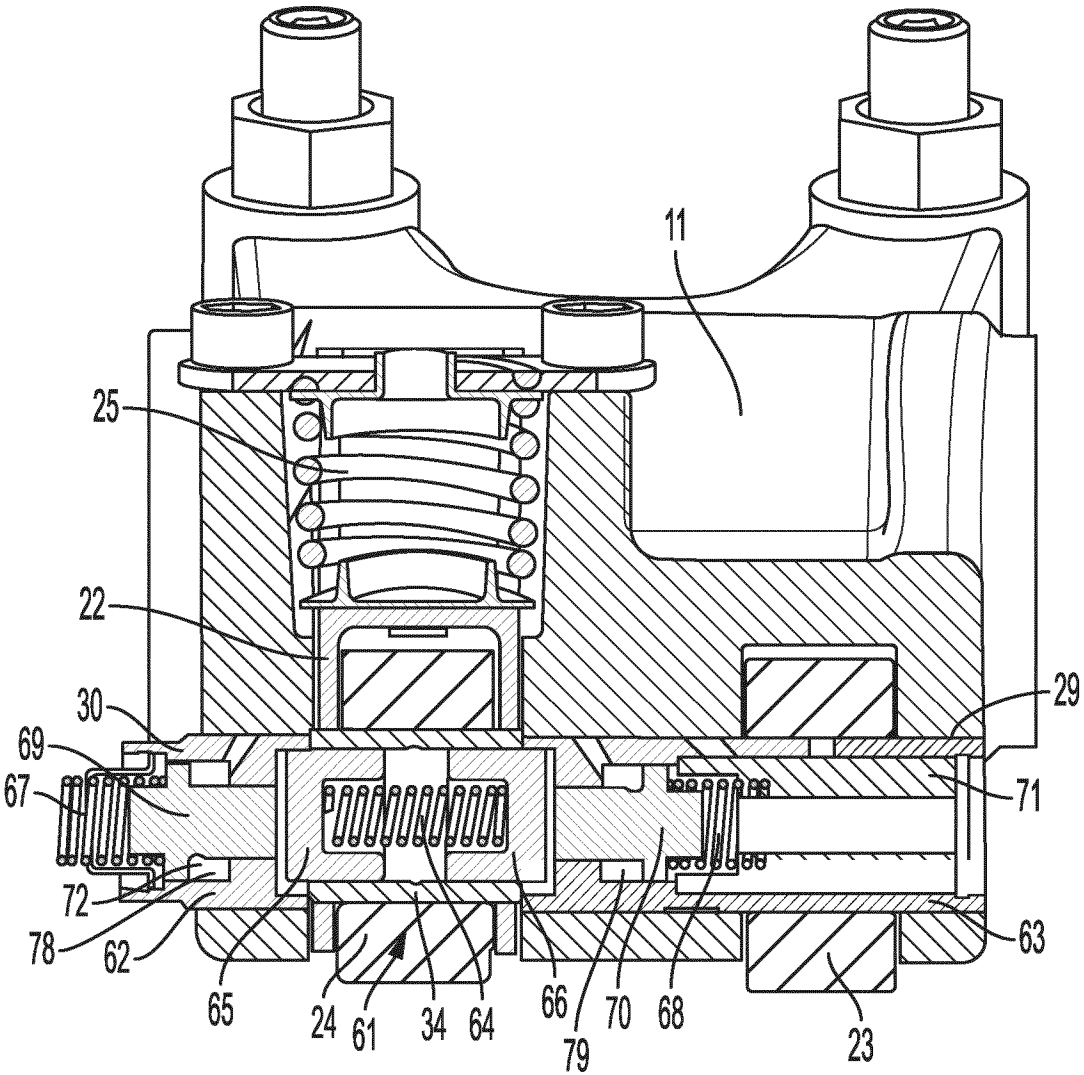
FIG. 8 is a cut-away profile view of a variable valve lift rocker arm assembly with roller deactivation in latched mode in a cam base circle position, the cut-away taken approximately from line 6 of FIG. 5.

In FIG. 5, secondary roller 24 can be in a latched state of FIG. 8 or the unlatched state of FIG. 6. When the secondary roller 24 is latched as in FIG. 8, secondary roller 24 and inner body 22 remain fixed with respect to outer body 11, and inner body 22 is unable to pivot relative to outer body 11, and vice versa. Any force from the camshaft lobe and resulting motion is conveyed to valve ends 12 and/or 13 of outer body 11. Lost motion spring 25 remains uncompressed. Note that main roller 23, like secondary roller 24, is fixed with respect to outer body 11.

FIG. 6 is a cut-away profile view of a variable valve lift rocker arm assembly 1 with roller deactivation and the roller latch assembly 61 in an unlatched mode, the cut-away taken approximately from line 6-6 of FIG. 5. FIG. 7 is a cut-away profile view of a variable valve lift rocker arm assembly 1 with roller deactivation and roller latch assembly 61 in an unlatched mode and secondary roller 24 is offset from cam lobe lift. FIG. 8 is a cut-away profile view of a variable valve lift rocker arm assembly 1 with the secondary roller 24 in latched mode.

Axle bore 29 runs through outer body 11 and main roller 23. Inner axle bore 32 runs through inner body 22 and secondary roller 24. Axle bore 29 and inner axle bore 32 are configured to receive latching axle assembly 30. Latching axle assembly 30 forms an axle on which main roller 23 and secondary roller 24 can roll, but also comprises at least one roller latch assembly 61 and one first latch receiver assembly 62, though optional second latch receiver assembly 63 is shown here. Roller latch assembly 61 is operatively coupled to inner body 22 and secondary roller 24. First latch receiver assembly 62 and second latch receiver assembly 63 are operatively coupled to outer body 11. One latch receiver assembly can be coupled to main roller 23. Or, main roller 23 can be coupled via separate mechanisms to outer body 11. At least one latch receiver assembly should be coupled to outer body 11.

Roller latch assembly 61 comprises latch pin spring 64, first latch pin 65, and second latch pin 66. Roller latch assembly 61 can be seated in shaft busing 34. Shaft bushing 34 can be inserted in inner axle bores 32 of inner body arms 221, 222, or shaft bushing 34 can be integrally formed with inner body arms 221, 222. While two latch pins are illustrated, it is possible to use only one latch pin and one latch receiver assembly. The second latch pin can be converted to a blind bore or other spring-seating surface for latch pin spring 64, such as a plug or circlip. Secondary roller 24 is mounted to shaft bushing 34. Roller latch assembly 61 can interlock with at least the first latch receiver assembly 62 as described below.

It is possible to include spacers or travel limits in the roller latch assembly 61. First latch pin 65 and second latch pin 66 are shown as hollow pistons that can cup the latch pin spring 64. The first latch pin 65 and second latch pin 66 can comprise body portions that can be slidable within shaft bushing 34. The body portions can extend from roller latch assembly 61 to seat in first latch receiver assembly 62 and second latch receiver assembly 63. First latch pin 65 and second latch pin 66 are slidable within first latch receiver assembly 62 and second latch receiver assembly 63 to enable a latching mode. Each end of latch pin spring 64 is biased, effectively anchored, to each of first latch pin 65 and second latch pin 66. An alternative could include a divider wall and two latch pin springs 64. If only one latch pin is present, one end of latch pin spring 64 is biased against first latch pin 65 while the other end of latch pin spring 64 is otherwise biased against the interior of roller latch assembly 61. Roller latch assembly 61 can also comprise mechanisms to anchor first latch pin 65 and second latch pin 66 to a latch guide rod or to the interior of roller latch assembly 61 for such purposes as travel limiting, force distribution, among others.

First latch receiver assembly 62 comprises first piston spring 67, first piston 69, and first spring chamber 72. Second latch receiver 63 comprises second piston spring 68, second piston 70, guide rod 71, and second spring chamber 73. First spring chamber 72 can be formed in the interior of first latch receiver assembly 62. A mating retainer 671 such as a cap or cage can secure the first piston spring 67 in place. Second spring chamber 73 can also be formed in the interior of second latch receiver assembly 63. First spring chamber 72 and spring pressure chamber 73 can be sized so that first piston spring 67 and second piston spring 68 can bias the first piston 69 and second piston 70 against the roller latch assembly 61. The spring forces can be balance to either bias the roller latch assembly 61 to the latched mode or the unlatch mode, as design choices. As drawn, the spring forces among the latch pin spring 64, the first piston spring 67, and the second piston spring 68 is balanced so that the secondary roller 24 is in a default unlatched mode. The first and second latch pins 65, 66 are unlatched from the receiving cups 621, 631. At start-up of a related vehicle or machine, a deactivation sequence can be followed.

First pressure chamber 78 is operatively coupled to first actuation port 74 from which control fluid may enter first pressure chamber 78. When control fluid is depressurized, it may exit first pressure chamber 78 via leak down paths. A bleed port can be included in the retainer 671, as an option. Second pressure chamber 779 is operatively coupled to second actuation port 75. Optional bleed port 76 and lubrication port 77 can be included. Second actuation port 75 allows control fluid to enter second pressure chamber 79. When control fluid is depressurized, it may exit second pressure chamber 79 via bleed port 76 and leak down paths. Lubrication port 77 may allow the flow of lubricating fluid main roller 23. The control fluid causes the first and second pistons 69, 70 to withdraw into the first and second latch receiver assemblies 62, 63. Then, the first and second latch pins 65, 66 can push outward to latch in receiving cups 621, 631 for the latched mode. Should a biased-latched mode be desired, it is possible to reverse the spring chambers 72, 73 and pressure chambers 78, 79 and move the first and second actuation ports 74, 75 to feed spring chambers 72, 73 to push the first and second latch pistons 69, 70.

Guide rod 71 can be seated in the interior of second latching receiver assembly 63. Guide rod 71 can be configured to provide a portion of the second spring chamber 73. Guide rod 71 can be secured in place by a retainer such as a snap-ring, washer, plug, stake or the like. Second piston 70 can be slidably mounted in the second latching receiver assembly 63. One end of second piston spring 68 can be biased against guide rod 71 while the other end of second piston spring 68 can be biased against second piston 70. The second piston spring 68 can oppose the spring force from latch pin spring 64 conveyed by second latch pin 66.

For shorter latch receivers, guide rod 71 can be excluded with, for example, first piston 69 slidably mounted within first latch receiver assembly 62. A first end of first piston spring 67 can be seated in the interior of first latch receiver assembly 62 and a second end of first piston spring 67 can be seated against first piston 69.

Alternatively, first latch receiver assembly 62 can also comprise a guide rod with first piston 69 slidably mounted to the guide rod. A first end of first piston spring 67 can be affixed to the guide rod while the other end of first piston spring 67 can be seated against first piston 69.

Configurations for latch receivers with or without guide rod 71 may be combined, e.g. one receiver with a guide rod and another receiver without a guide rod as shown above. Or, configurations can comprise two receivers each with a guide rod, or two receivers both without guide rods. Furthermore, roller latch assembly 61 can be configured to operate with only a single latch pin and/or only a single latch receiver, rather than two of each.

First piston spring 67 and second piston spring 68 can exert greater force than latch pin spring 64. As seen in FIG. 6, when roller latch assembly 61 is in unlatched mode, the control fluid in pressure chambers 78, 79 is at a relatively low pressure, and first piston spring 67 and second piston spring 68 push first piston 69 and second piston 70 and, in turn, first latch pin 65 and second latch pin 66, thereby compressing latch pin spring 64 such that first latch pin 65 and second latch pin 66 are clear of first latch receiver assembly 62 and second latch receiver assembly 63. This allows roller latch assembly 61 with secondary roller 24 and inner body 22 to swing free of outer body 11 as seen in FIG. 7, and allows secondary roller 24 and inner body 22 to pivot relative to outer body 11. Forces from cam lobes can be transmitted directly or indirectly via secondary roller 24 thereby compressing lost motion spring 25.

As illustrated in FIG. 8, roller latch assembly 61 is in latched mode. Tension from lost motion spring 25 can place roller latch assembly 61 in alignment with first latch receiver assembly 62 and second latch receiver assembly 63, such that first latch pin 65 and second latch pin 66 of roller latch assembly 61 can interlock with receiving cups 621, 631 of first latch receiver assembly 62 and second latch receiver assembly 63. In first pressure chamber 78 and second pressure chamber 79, pressurized control fluid is directed at first piston 69 and second piston 70. This overcomes the spring forces of first piston spring 67 and second piston spring 68, allowing the latch pin spring 64 to extend and force first latch pin 65 and second latch pin 66 to latch in receiving cups 621, 631 of first latch receiver assembly 62 and second latch receiver assembly 63.

While this embodiment details a roller latch assembly 61 capable of latching and unlatching only secondary roller 24, the mechanisms of roller latch 61 can be readily modified and additional roller latch assemblies can be configured to accommodate latching and unlatching of additional rollers.

Figure 9:
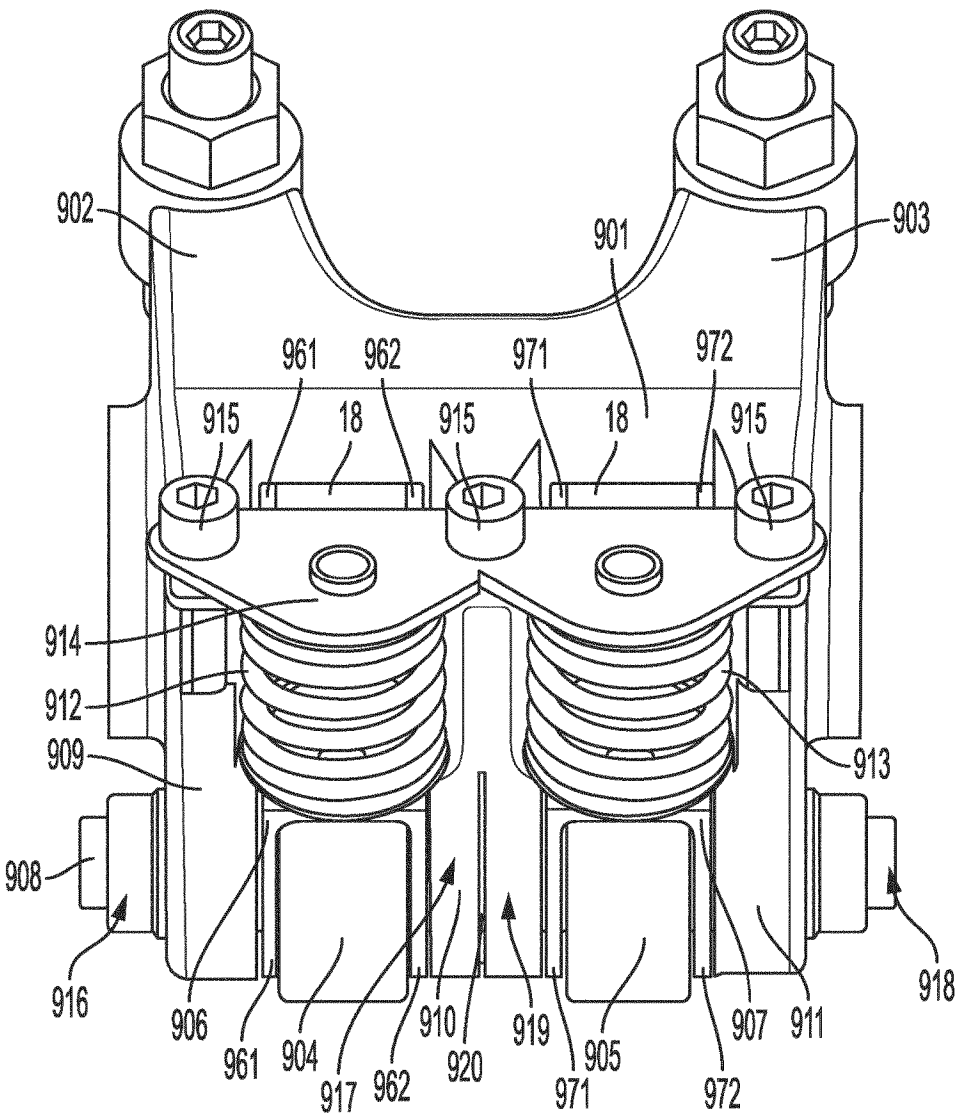
FIG. 9 is a perspective view of a variable valve lift rocker arm assembly with roller deactivation wherein two rollers can be deactivated.

FIG. 9 is a perspective view of a variable valve lift rocker arm assembly with roller deactivation wherein two rollers can be deactivated. The first latch receiver assembly 62 is duplicated in mirror image about a cleave 921. And, the first latch receiver assemblies, so duplicated, are distal to cleave 921. The second latch receiver assembly 63 can be duplicated without the guide rod 71, in mirror image, and can be proximal to cleave 921.

As shown in FIG. 9, outer body 901 comprises first valve end 902 and second valve end 903 on the valve side of outer body 901. A rocker shaft or bushing can be configured as above to secure the outer body 901 and inner bodies 906, 907 for rotation and valve actuation modes. A first inner shaft bore can run through first inner body 906 and a second inner shaft bore can run through second inner body 907. First inner shaft bore and second inner shaft bore can be configured to receive the rocker shaft, bushing, or pivoting axle. First inner body 906 and second inner body 907 are rotatably mounted to outer body 901 by the rocker shaft, bushing, or pivoting axle.

The cam side of rocker arm assembly 1 includes secondary roller 904 and main roller 905. Secondary roller 904 and main roller 905 are mounted to first inner body 906 and second inner body 907 respectively. A latching axle assembly 908 can run through an outer axle bore, a first inner axle bore on first inner body 906, and a second inner axle bore on second inner body 907, which are configured to receive latching axle assembly 908. The outer axle bore, first inner axle bore, and second inner axle bore, as well as latching axle 908, runs through first cam end 909, second cam end 910, and third cam end 911 of outer body 901, first inner body 906, second inner body 907, secondary roller 904, and main roller 905.

Latching axle assembly 908 comprises first latch receiver assembly 916, a first roller latch assembly, a second latch receiver assembly 917, a second roller latch assembly, a fourth latch receiver assembly 919, and a third latch receiver assembly 918. The first through fourth latch receiver assemblies, being fluid controlled, can cause the first through fourth latch pins to selectively engage or disengage with the corresponding receiving cups in the first through fourth latch receiver assemblies. First latch receiver assembly 916 is similar in seating and actuation as first latch receiver assembly 62 of FIG. 6-8. Second latch receiver assembly 917 is similar in seating and actuation to the second latch receiver assembly 63 of FIG. 6-8, but without guide rod 71. Second latch receiver assembly 917 and fourth latch receiver assembly 919 can be separated by a cleave 920. Third latch receiver assembly 918 is a mirror image to first latch receiver assembly 916, while fourth latch receiver assembly 919 is a mirror image to second latch receiver assembly 917. While the latch receivers are enumerated first through fourth in the description, they are numbered in the claims in the order in which they are introduced in the claims.

Both first roller latch assembly and second roller latch assembly are similar in seating and actuation as roller latch assembly 61 of FIG. 6-8. First roller latch assembly is seated in secondary roller 904 and second roller latch assembly is seated within main roller 905 as taught above for FIGS. 6-8.

First inner body 906 and second inner body 907 can operably be connected to outer body 901 with first lost motion spring 912 and second lost motion spring 913. One end of each first lost motion spring 912 and second lost motion spring 913 can be connected to outer body 901 by outer lost motion spring retainer 914. In turn, outer lost motion spring retainer 914 can be mounted to outer lost motion spring retainer posts 915 of outer body 901. The other end of each first lost motion spring 912 and second lost motion spring 913 can be connected to first inner body 906 and second inner body 907, respectively, via inner lost motion spring retainers.

In this embodiment, either main roller or secondary roller can be latched or unlatched, singly or jointly. This allows for four distinct lift combinations including main roller 905 latched with secondary roller 904 unlatched; main roller 905 unlatched with secondary roller 904 latched; both main roller 905 and secondary roller 904 latched which allows for a "double lift" or "ghost lift"; or both main roller 905 and secondary roller 904 unlatched to allow for cylinder deactivation.

While the above embodiments describe an outer body 22, 901 with a first valve end 12, 902 and a second valve end 13, 903, the embodiments may be modified to allow for fewer or additional valve ends as may be required by design parameters. Similarly, while the above embodiments describe a rocker arm assembly 1 with a main roller 23, 905 and a secondary roller 24, 904, the rocker arm assembly 1 may be modified to allow for fewer or additional rollers, any combination of which may be capable of latching and unlatching.

Other implementations will be apparent to those skilled in the art from consideration of the specification and practice of the examples disclosed herein.

In view of the foregoing, it can be said that a variable valve lift rocker arm assembly can include a latching axle assembly comprising a roller latch assembly and a first latch receiver assembly; an outer body configured to rotate around a rocker shaft, the outer body comprising at least a valve end, and a cam end comprising an outer axle bore for seating the first latch receiver assembly of the latching axle assembly; an inner body configured to rotate around the rocker shaft, the inner body comprising an inner axle bore configured for seating the roller latch assembly of the latching axle assembly; a main roller operatively coupled to the outer body; and a secondary roller operatively coupled to the inner body; wherein the roller latch assembly and the first latch receiver assembly are configured to selectively operatively couple the outer body to the inner body.

A variable valve lift rocker arm assembly can include a roller latch assembly seated in a shaft bushing within a secondary roller.

A variable valve lift rocker arm assembly can include a roller latch assembly comprising a first latch pin, wherein the first latch pin is configured to move between a latched position, in which the first latch pin engages with a first latch receiver assembly to lock the relative rotation between an inner body and an outer body, and an unlatched position, in which the first latch pin disengages from the first latch receiver assembly to enable relative rotation between the inner body and the outer body.

A variable valve lift rocker arm assembly can include a roller latch assembly further comprising a second latch pin: wherein a latching axle assembly further comprises a second latch receiver assembly in an outer body, wherein the second latch pin is configured to engage with the second latch receiver assembly in the latched position, and wherein the second latch pin is configured to disengage from the second latch receiver assembly in the unlatched position.

A variable valve lift rocker arm assembly can include a first latch receiver configured to selectively press on a roller latch assembly to selectively unlatch an inner body from an outer body.

A variable valve lift rocker arm assembly can include a latching axle assembly comprising a first roller latch assembly, a second roller latch assembly, first latch receiver assembly, and a second latch receiver assembly; an outer body comprising: at least one valve end; an outer bore shaft; and an axle bore for receiving a first portion of the latching axle assembly; a first inner body comprising: a first inner bore shaft; and a first inner axle bore for receiving a second portion of the latching axle assembly; a second inner body comprising: a second inner bore shaft; and a second inner axle bore for receiving a third portion of the latching axle assembly; a first roller operatively coupled to the first roller latch assembly and the first inner body; and a second roller operatively coupled to the second roller latch assembly and the second inner body; wherein the first latch receiver assembly and the second latch receiver assembly are operatively coupled to the outer body, wherein the first roller latch assembly is configured to selectively latch or unlatch with the first latch receiver assembly, wherein the second roller latch assembly is configured to selectively latch or unlatch with the second latch receiver assembly, wherein the outer body is selectively operatively coupled to the first inner body and to the second inner body by the latching axle assembly, and wherein the first inner body and the second inner body are configured to selectively rotate, independently of the other, relative to the outer body.

A variable valve lift rocker arm assembly can include a first roller latch assembly comprising a first latch pin; wherein a second roller latch assembly comprises a second latch pin; wherein the first roller latch assembly is configured to latch or unlatch with a first latch receiver assembly via the first latch pin; wherein the second roller latch assembly is configured to latch or unlatch with a second latch receiver assembly via the second latch pin.

A variable valve lift rocker arm assembly can include a latching axle assembly further comprising a third latch receiver assembly and a fourth latch receiver assembly; wherein the third latch receiver assembly and the fourth latch receiver assembly are operatively coupled within an outer body; wherein a second latch roller assembly is configured to selectively latch or unlatch with the third latch receiver assembly; wherein a first latch roller assembly is configured to selectively latch or unlatch with the fourth latch receiver assembly.

A variable valve lift rocker arm assembly can include a first roller latch assembly comprising a first latch pin and a fourth latch pin; wherein a second roller latch assembly comprises a second latch pin and a third latch pin, wherein a first latch receiver assembly is configured to engage or disengage the first latch pin, wherein a third latch receiver assembly is configured to engage or disengage the third latch pin, wherein a second latch receiver assembly is configured to engage or disengage the second latch pin, and wherein a fourth latch receiver assembly is configured to engage or disengage the fourth latch pin.

A variable valve lift rocker arm assembly can include a first roller latch assembly and a second roller latch assembly that are independently latched or unlatched.

A variable valve lift rocker arm assembly can include a first lost motion spring operatively coupled to an outer body and to a first inner body; and a second lost motion spring operatively coupled to the outer body and to a second inner body.

A variable valve lift rocker arm assembly can include a first roller lying on a same axis as a second roller when both the first roller and the second roller are in cam base circle position.

A variable valve lift rocker arm assembly can include a latching axle assembly; an outer body comprising at least one valve end, an outer bore shaft, and an outer axle bore for receiving the latching axle assembly; an inner body comprising an inner bore shaft and an inner axle bore for receiving the latching axle assembly; and a roller operatively coupled to the latching axle assembly and the inner body, wherein the outer body is operatively coupled to the inner body by the latching axle assembly, wherein the outer body is configured to selectively rotate relative to the inner body via the rocker shaft, wherein the latching axle assembly comprises a roller latch assembly operatively coupled to the inner body and to the roller, and wherein a first latch receiver assembly is operatively coupled to the outer body.

A variable valve lift rocker arm assembly can include a roller latch assembly comprising a first latch pin, and wherein the first latch pin is configured to engage with a first latch receiver assembly to move between a latched position, in which the first latch pin engages with the first latch receiver assembly to lock the relative rotation between an inner body and an outer body, and an unlatch position, in which the first latch pin disengages from the first latch receiver assembly to allow relative rotation between the inner body and the outer body.

A variable valve lift rocker arm assembly can include a roller latch assembly comprising a second latch pin, an outer body comprising a second latch receiver assembly, a first latch pin and the second latch pin are configured to engage with a first latch receiver assembly and the second latch receiver assembly in a latched position, in which the first latch pin engages with the first latch receiver assembly and the second latch pin engages with the second latch receiver assembly to lock the relative rotation between an inner body and an outer body, and the first latch pin and the second latch pin are configured to engage with the first latch receiver assembly and the second latch receiver assembly in an unlatched position, in which the first latch pin disengages from the first latch receiver assembly and the second latch pin disengages from the second latch receiver assembly to allow relative rotation between the inner body and the outer body.

What is claimed is:

1. A variable valve lift rocker arm assembly comprising:

a latching axle assembly comprising a roller latch assembly, a first latch receiver assembly, and a second latch receiver in an outer body;

the outer body configured to rotate around a rocker shaft, the outer body comprising one or more valve ends and a plurality of cam ends forming a rotationally coupled integral structure with the one or more valve ends, the plurality of cam ends comprising an outer axle bore for seating the first latch receiver assembly of the latching axle assembly;

an inner body comprising an inner axle bore disposed parallel to the rocker shaft and configured for seating the roller latch assembly of the latching axle assembly;

a main roller operatively coupled to the outer body; and a secondary roller operatively coupled to the inner body;

wherein the roller latch assembly is seated in a shaft bushing within the secondary roller;

wherein the roller latch assembly comprises a first latch pin configured to move between a latched position and an unlatched position;

wherein the roller latch assembly further comprises a second latch pin configured to engage with the second latch receiver assembly in the latched position and to disengage from the second latch receiver assembly in the unlatched position;

wherein the roller latch assembly and the first latch receiver assembly are configured to selectively operatively couple the outer body to the inner body, and wherein the inner body is axially enclosed and supported by a forked portion of the outer body formed by the plurality of cam ends of the outer body.

2. The variable valve lift rocker arm assembly of claim 1, wherein the first latch pin engages with the first latch receiver assembly to prevent relative rotation between the inner body and the outer body, and wherein the first latch pin disengages from the first latch receiver assembly to enable relative rotation between the inner body and the outer body.

3. The variable valve lift rocker arm assembly of claim 1, wherein the first latch receiver assembly is configured to selectively press on the roller latch assembly to selectively unlatch the inner body from the outer body.

4. The variable valve lift rocker arm assembly of claim 1, wherein the inner body further comprises an inner shaft bore.

5. The variable valve lift rocker arm assembly of claim 4, wherein the inner shaft bore is configured to receive the rocker shaft.

6. A variable valve lift rocker arm assembly, comprising:

a latching axle assembly comprising a first roller latch assembly, a second roller latch assembly, a first latch receiver assembly, and a second latch receiver assembly;

an outer body comprising:

one or more valve ends; and an axle bore comprising one or more sections configured for receiving the first latch receiver assembly and the second latch receiver assembly;

a first inner body comprising a first inner axle bore configured for receiving at least a portion of the first roller latch assembly;

a second inner body comprising a second inner axle bore configured for receiving at least a portion of the second roller latch assembly;

a first roller operatively coupled to one or more of the first roller latch assembly or the first inner body; and a second roller operatively coupled to one or more of the second roller latch assembly or the second inner body;

wherein the first roller latch assembly is configured to selectively latch or unlatch with the first latch receiver assembly, wherein the second roller latch assembly is configured to selectively latch or unlatch with the second latch receiver assembly, wherein each of the first inner body and the second inner body is configured to be selectively rotationally lockable to the outer body independent of the other of the first inner body and the second inner body, and wherein the outer body further comprises a plurality of cam ends forming a rotationally coupled integral structure with the one or more valve ends, wherein each of the first inner body and the second inner body is axially enclosed and supported by a respective forked portion of the outer body formed by the plurality of cam ends of the outer body.

7. The variable valve lift rocker arm assembly of claim 6, wherein the first roller latch assembly comprises a first latch pin, wherein the second roller latch assembly comprises a second latch pin, wherein the first roller latch assembly is configured to latch or unlatch with the first latch receiver assembly via the first latch pin, and wherein the second roller latch assembly is configured to latch or unlatch with the second latch receiver assembly via the second latch pin.

8. The variable valve lift rocker arm assembly of claim 6, wherein the latching axle assembly further comprises a third latch receiver assembly and a fourth latch receiver assembly, wherein the third latch receiver assembly and the fourth latch receiver assembly are operatively coupled within the outer body, wherein the second roller latch assembly is configured to selectively latch or unlatch with the third latch receiver assembly, and wherein the first roller latch assembly is configured to selectively latch or unlatch with the fourth latch receiver assembly.

9. The variable valve lift rocker arm assembly of claim 8, wherein the first roller latch assembly comprises a first latch pin and a fourth latch pin, wherein the second roller latch assembly comprises a second latch pin and a third latch pin, wherein the first latch receiver assembly is configured to engage or disengage the first latch pin, wherein the third latch receiver assembly is configured to engage or disengage the third latch pin, wherein the second latch receiver assembly is configured to engage or disengage the second latch pin, and wherein the fourth latch receiver assembly is configured to engage or disengage the fourth latch pin.

10. The variable valve lift rocker arm assembly of claim 6, wherein the first roller latch assembly and the second roller latch assembly are independently latched or unlatched.

11. The variable valve lift rocker arm assembly of claim 6, further comprising:

a first lost motion spring operatively coupled to the outer body and to the first inner body; and a second lost motion spring operatively coupled to the outer body and to the second inner body.

12. The variable valve lift rocker arm assembly of claim 6, wherein the first roller lies on a same axis as the second roller when both the first roller and the second roller are in cam base circle position.

13. The variable valve lift rocker arm assembly of claim 6, wherein the first roller latch assembly is at least partially disposed within the first roller, and wherein the second roller latch assembly is at least partially disposed within the second roller.

14. A variable valve lift rocker arm assembly, comprising:

a latching axle assembly comprising a first roller latch assembly, a second roller latch assembly, a first latch receiver assembly, and a second latch receiver assembly;

an outer body comprising:

one or more valve ends; and an axle bore comprising one or more sections configured for receiving the first latch receiver assembly and the second latch receiver assembly;

a first inner body comprising a first inner axle bore for receiving at least a portion of the first roller latch assembly;

a first lost motion spring operatively coupled to the outer body and to the first inner body;

a second inner body comprising a second inner axle bore for receiving at least a portion of the second roller latch assembly;

a second lost motion spring operatively coupled to the outer body and to the second inner body;

a first roller operatively coupled to one or more of the first roller latch assembly or the first inner body; and a second roller operatively coupled to one or more of the second roller latch assembly or the second inner body;

wherein the first roller latch assembly is configured to selectively latch or unlatch with the first latch receiver assembly, wherein the second roller latch assembly is configured to selectively latch or unlatch with the second latch receiver assembly, wherein the first inner body and the second inner body are configured to selectively rotate, independent of the other of the first inner body and the second inner body, relative to the outer body, and wherein the outer body further comprises a plurality of cam ends forming a rotationally coupled integral structure with the one or more valve ends, wherein each of the first inner body and the second inner body is axially enclosed and supported by a respective forked portion of the outer body formed by the plurality of cam ends of the outer body.

15. The variable valve lift rocker arm assembly of claim 14, wherein the first roller latch assembly comprises a first latch pin, wherein the second roller latch assembly comprises a second latch pin, wherein the first roller latch assembly is configured to latch or unlatch with the first latch receiver assembly via the first latch pin, and wherein the second roller latch assembly is configured to latch or unlatch with the second latch receiver assembly via the second latch pin.

16. The variable valve lift rocker arm assembly of claim 14, wherein the latching axle assembly further comprises a third latch receiver assembly and a fourth latch receiver assembly, wherein the third latch receiver assembly and the fourth latch receiver assembly are operatively coupled within the outer body, wherein the second roller latch assembly is configured to selectively latch or unlatch with the third latch receiver assembly, and wherein the first roller latch assembly is configured to selectively latch or unlatch with the fourth latch receiver assembly.

17. The variable valve lift rocker arm assembly of claim 16, wherein the first roller latch assembly comprises a first latch pin and a fourth latch pin, wherein the second roller latch assembly comprises a second latch pin and a third latch pin, wherein the first latch receiver assembly is configured to engage or disengage the first latch pin, wherein the third latch receiver assembly is configured to engage or disengage the third latch pin, wherein the second latch receiver assembly is configured to engage or disengage the second latch pin, and wherein the fourth latch receiver assembly is configured to engage or disengage the fourth latch pin.

18. The variable valve lift rocker arm assembly of claim 14, wherein the first roller latch assembly and the second roller latch assembly are independently latched or unlatched.

19. The variable valve lift rocker arm assembly of claim 14, wherein the first roller lies on a same axis as the second roller when both the first roller and the second roller are in cam base circle position.

* * * * *